United States Patent [19]

Jones

[11] 4,162,740

[45] Jul. 31, 1979

[54] VALVE COVER

[76] Inventor: Clifford W. Jones, 7068 S. Lafayette Way, Littleton, Colo. 80122

[21] Appl. No.: 837,518

[22] Filed: Sep. 29, 1977

[51] Int. Cl.[2] ..... B65D 25/00; B65D 25/24; B65D 51/04

[52] U.S. Cl. ..... 220/85 P; 220/18; 220/306; 220/337; 137/382

[58] Field of Search ..... 220/18, 85 F, 85 P, 220/85 TC, 306, 337, 8, 329, 331, 324, 325, 346, 284, 285, 323, 326; 137/382, 527.6

[56] References Cited

U.S. PATENT DOCUMENTS

| | | | |
|---|---|---|---|
| 311,871 | 2/1885 | Clark | 220/8 |
| 785,380 | 3/1905 | Ripson | 220/306 X |
| 826,464 | 7/1906 | Anthony | 220/337 |
| 1,080,859 | 12/1913 | Stamm | 220/326 X |
| 1,239,223 | 9/1917 | Ross | 220/306 |
| 2,324,738 | 7/1943 | Stieglitz | 220/306 |
| 2,690,274 | 9/1954 | Thurston | 220/326 |
| 3,541,727 | 11/1970 | Carlson | 220/18 X |
| 3,605,718 | 9/1971 | Winters | 220/337 |
| 3,847,297 | 11/1974 | Baader et al. | 220/85 P |

*Primary Examiner*—Steven M. Pollard
*Attorney, Agent, or Firm*—Burton & Dorr

[57] ABSTRACT

A valve cover for an upstanding pipe leading to a buried valve. The valve cover has a clamping portion and a lid portion. The clamping portion includes a C-shaped member with back portions that abut each other when the C-shaped member is secured about the pipe. Each back portion has first and second sections which meet at a substantially right angle and the two, abutting back portions form a substantially U shape. The lid portion is pivotably mounted to the clamping portion and has a first, circular section and a tail section extending at an angle therefrom. The tail section is received within the U shape formed by the back portions and has two, axially aligned arm members extending outwardly therefrom. The arm membes are received in a pair of axially aligned holes in the back portions to form a hinge. A resilient latching arrangement allows the lid portion to be quickly and easily opened and closed. In its closed position, the lid portion is biased in a direction toward its open position so that when the latching arrangement is released, the lid portion pops up. The valve cover of the present invention is designed so that its height on the pipe can be easily and quickly adjusted and the simplicity of the design not only permits low cost manufacture but also greatly facilitates the assembly of the valve cover.

31 Claims, 8 Drawing Figures

VALVE COVER

FIELD OF THE INVENTION

This invention relates to the field of valve covers and more particularly to the field of valve covers for upstanding pipes leading to buried valves.

BACKGROUND OF THE INVENTION AND PRIOR ART

Valve covers are typically placed over the upper ends of upstanding pipes leading to buried valves to prevent dirt and other material from entering the pipes and covering up the valves or clogging their working parts.

U.S. Pat. No. 43,056 to Weldon issued on June 7, 1864 illustrates such a valve cover arrangement in which a cap h is screwed onto the upper end of the pipe A leading to the buried valve g. Lid i is pivotably mounted to the cap h and is movable to alternately provide and prevent access to the valve g. As illustrated by Weldon, a rod E can be either permanently positioned within the upstanding A or inserted into the upstanding pipe to reach and manipulate the buried valve. U.S. Pat. No. 420,044 to Dennis issued on Jan. 28, 1890 and U.S. Pat. No. 2,099,479 to Heinkel et al issued on Nov. 16, 1937 illustrate valve cover arrangements in which the valve cover is mounted to the upstanding pipe by a screw arrangement. The height of the valve cover relative to the upstanding pipe can be adjusted as desired by turning the valve cover clockwise or counterclockwise. The screw-thread patterns of these two patents are not continuous and have vertically extending channels to drain away water and mud. The lids of Dennis and Heinkel are held in place by manipulating a screw and they cannot be easily and quickly opened and closed.

U.S. Pat. No. 988,974 to Chapman issued on Apr. 11, 1911 illustrates a valve cover with a pivotably mounted lid D. Like Dennis and Weldon, the lid is also held in place by manipulating a screw and it appears that the lid can only be opened by placing a tool or other device in the screw hole once the screw E is removed and prying the lid open or by gripping the hinge knuckle D'. Chapman's lower portion C is slidably mounted about the upstanding pipe A and can be selectively held against movement relative to the pipe A by manipulating screws F as illustrated in FIG. 3.

U.S. Pat. No. 2,217,097 to Brooks issued on Oct. 8, 1940 illustrates a meter box cover with latches 26 that are pivotably mounted to the lid 9. As Brooks' lid 9 closes, the latches 26 ride over the surfaces 31 and 32 and eventually abut the surfaces 33 where they are held in place by the counterweights on the arms 34. To open Brooks' lid 9, a T-shaped implement 36 must be inserted into the slot 35 and then rotated at a right angle so that the head of the T is beneath each of the arms 34. The implement 36 is then raised to move the latches 26 away from engagement with the surfaces 33 and to open the lid 9. U.S. Pat. No. 3,858,755 to Tellen illustrates a meter box cover which has a latch that is pivotably mounted either about a horizontal axis or vertical axis and which is biased toward engagement with the flange 4 of the box 1 by a spring. Like Brooks, Tellen's lid 3 can only be opened by inserting a tool 20 through a hole in the lid to contact and pull the latch away from engagement with the flange 4. U.S. Pat. No. Re. 28,640 to Sauriol reissued on Dec. 9, 1975 illustrates a meter housing which has a removable cover 16 that is designed to be locked in place over the inlet to the housing 10. To remove the cover 16, a key must be inserted through the aperture 40 to disengage the locking mechanism.

All of these prior art valve cover arrangements have one or more serious drawbacks. Weldon's arrangement cannot be adjusted up or down by more than a few screw threads of cap h. Dennis, Heinkel, and Chapman are all rather complex in design and difficult to manufacture and assemble as well as having lids that cannot be easily and quickly opened and closed. The latching arrangments of Brooks, Tellen, and Sauriol are also very complex and, likewise, their lids cannot be easily and quickly opened and closed.

The ideal valve cover for a pipe leading to a valve would be simple in design, inexpensive to make, and would substantially prevent dirt and other material from passing when the lid of the valve cover is closed. It would also be easily assembled, easily opened and closed, and easily moved up or down relative to the pipe. The present invention offers such a valve cover.

SUMMARY OF THE INVENTION

The present invention involves a valve cover for use with a pipe leading to a valve. The valve cover has a clamping portion that can be selectively secured about the pipe at any desired height. The clamping portion includes a C-shaped member with back portions that preferably abut each other when the C-shaped member is secured about the pipe. In this preferred manner of operation, the C-shaped member forms a substantially cylindrical or tubular shape with two open ends. The lid portion includes a lid member with a first, circular section and a tail section. The tail section is pivotably mounted to the clamping portion and the lid can be selectively moved about an axis between an open and closed position to alternately provide and prevent access to the interior of the clamping portion.

Each back portion of the C-shaped member has a first section extending outwardly of the central axis of the C-shaped member and a second section extending at a substantially right angle thereto toward the corresponding second section of the other back portion. In the preferred manner of operation, the second sections abut each other with the first sections being spaced apart. The tail section of the lid extends at an angle from the lid's first section and is received between the spaced apart first sections of the C-shaped member's back portions. In this manner, dirt and other materials is prevented from entering into the clamping portion at the back when the lid is closed. The pivoting or hinge arrangement between the lid portion and the clamping portion includes two axially aligned arms that extend outwardly from the tail section of the lid and two axially aligned holes in the first sections of the C-shaped member's back portions into which the arm members are received.

The latching arrangement for the valve cover includes a first member resiliently attached at one end to the clamping portion and having a free standing end with a detent. The latching arrangement further includes a second member attached to the first section of the lid and also having a free standing end. The free standing end of the second member contacts a cam surface on the detent as the lid is closed to move the first member outwardly of the clamping portion. Once the free end of the second member moves downwardly beyond the detent, the first member resiliently snaps back toward the interior of the clamping portion with the detent positioned above the free end of the second member. The arm members of the hinge are positioned on the tail section of the lid so that they tightly contact the upper portions of the holes as the lid closes. In this manner, the lid is biased against the top edges of the clamping portion as it closes and while it is in its closed position. To release the latching arrangement, a tool or other device is inserted through a hole in the lid and pressed against the first member of the latching arrangement to move it outwardly of the clamping portion. This releases the free end of the second member from beneath the detent and the biasing force of the lid against the top edges of the clamping portion causes the lid to pop up.

OBJECTS OF THE INVENTION

It is an object of this invention to provide a new and novel valve cover which is inexpensive to manufacture and easy to assemble.

Another object of the invention is to provide a new and novel valve cover that can be selectively secured about a pipe leading to a valve whereby the height of the valve cover relative to the pipe can be easily and quickly adjusted.

It is an object of this invention to provide a new and novel valve cover which has a substantially C-shaped clamping member that can be easily and quickly placed about an upstanding pipe and selectively secured thereto at any desired location.

It is an object of this invention to provide a new and novel valve cover which can be easily and quickly opened and closed.

Another object is to provide a new and novel valve cover with a lid portion that is biased away from its latched, closed position so that when the latching arrangement is released, the lid portion pops up.

It is also an object to provide a new and novel valve cover with an improved design for preventing dirt and other material from entering the valve cover when it is in its closed position.

Another object is to provide a new and novel valve cover which has a clamping portion that is placed about and frictionally engages the outer surface of a pipe and which can be releasably secured to pipes of varying diameters.

Additional objects as well as features and advantages of this invention will become evident from the descriptions set forth hereinafter when considered in conjunction with the accompanying drawings.

BRIEF DESCRIPTION OF THE DRAWINGS

FIG. 6 also illustrates the manner in which the lid portion contacts the upper edges of the clamping portion as the lid portion closes to bias it away from the latched closed position. With this arrangement, the lid portion will pop up when the latching arrangement is released.

DETAILED DESCRIPTION OF THE PREFERRED EMBODIMENTS

Figure 1:
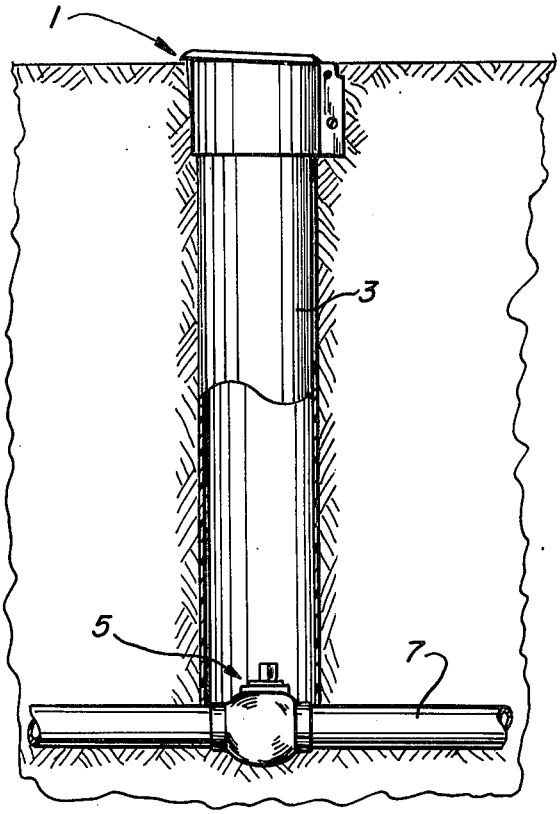
FIG. 1 is a view of the valve cover of the present invention in use with an upstanding pipe leading to a buried valve in a lawn sprinkler system.

FIG. 1 illustrates the valve cover 1 of the present invention in use with an upstanding pipe 3 leading to a buried valve 5 which controls the flow to the underground pipe 7. The valve cover 1 can be used with any pipe leading to a valve; however, in the preferred environment, the valve cover 1 is used with a lawn sprinkler system. In this environment, the valve cover 1 also serves as a valve marker. The valve cover 1 of the present invention has a height adjustability feature that enables it to be easily and quickly moved up or down on the upstanding pipe 3 as the ground level changes. Such changes in ground level commonly occur annually and often times even more frequently. With the height adjustability feature of the present invention, the valve cover 1 can be moved up or down on the upstanding pipe 3 so as to maintain the same height relative to the ground level. Past valve covers which are not adjustable have problems in that they stick up too far when the ground level sinks so as to interfere with mowing operations or present a potentially dangerous obstacle to persons walking or playing on the lawn. Further, valve controls that are not adjustable may become buried if the ground level rises. Valve covers such as the one in the present invention are designed primarily to prevent dirt and other material from entering the upstanding pipe 3 and covering the buried valve 5 or clogging its working parts.

Figure 2:
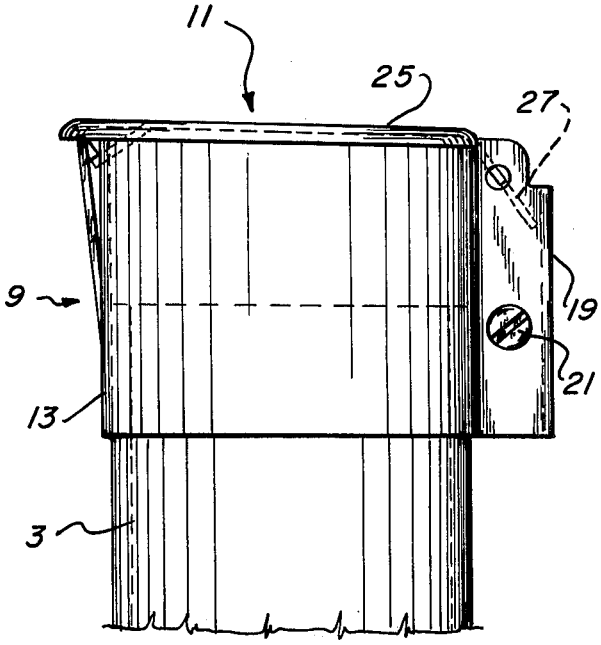
FIG. 2 is a cross-sectional view of the valve cover illustrating several of the main features of the clamping portion and lid portion of the present invention.
Figure 3:
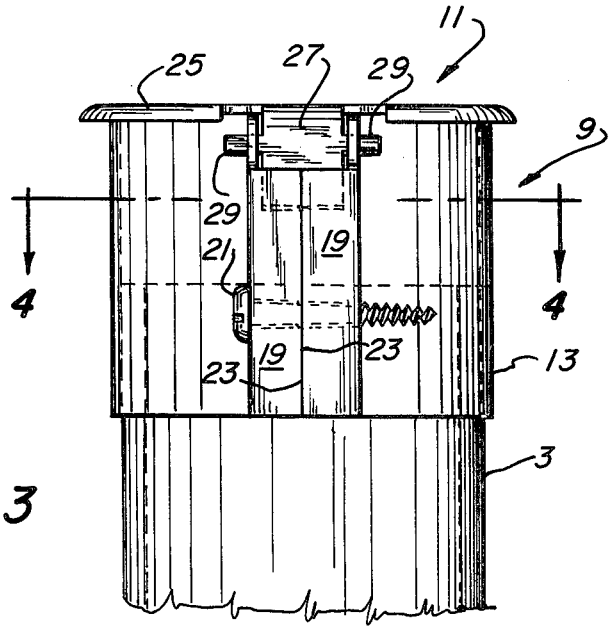
FIG. 3 is a view along line 3—3 of FIG. 2 illustrating the back portions of the clamping member as well as the tail section of the lid portion and the manner in which the lid portion is pivotably mounted to the clamping portion.
Figure 4:
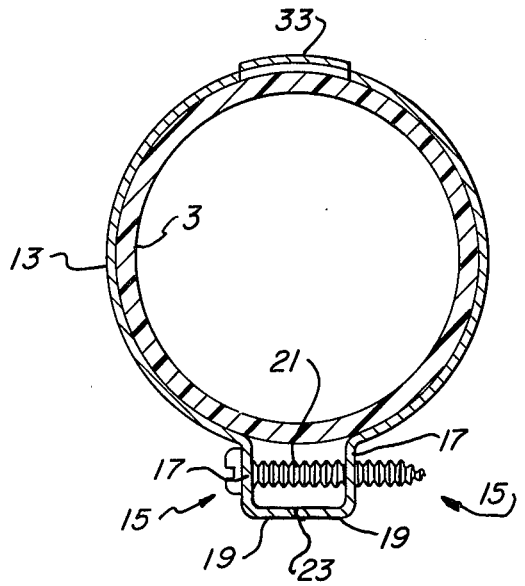
FIG. 4 is a view along line 4—4 of FIG. 3 illustrating how the edges of the C-shaped clamping member abut each other in the preferred operation as the clamping member frictionally engages the outer surface of the upstanding pipe leading to the buried valve.

As best seen in FIGS. 2–4, the valve cover of the present invention has a clamping portion 9 and a lid portion 11. The clamping portion 9 includes a substantially C-shaped member 13 which has two, back portions 15 as shown in FIG. 4. Each back portion 15 has a first section 17 extending outwardly from the central axis of the C-shaped member 13 and a second section 19 extending at a substantially 90° angle thereto toward the corresponding second section 19 of the other back portion 15. In operation, the C-shaped member 13 is placed about the upper end portion of the pipe 3 at a desired height and the screw 21 tightened to draw the back portions 15 toward each other whereby the C-shaped member 13 frictionally engages the pipe 3. In the preferred operation, the edges 23 of the back portions 15 abut each other as shown in FIG. 4. In this preferred operation, the C-shaped member 13 forms a substantially cylindrical or tubular shape which has two open ends.

Figure 5:
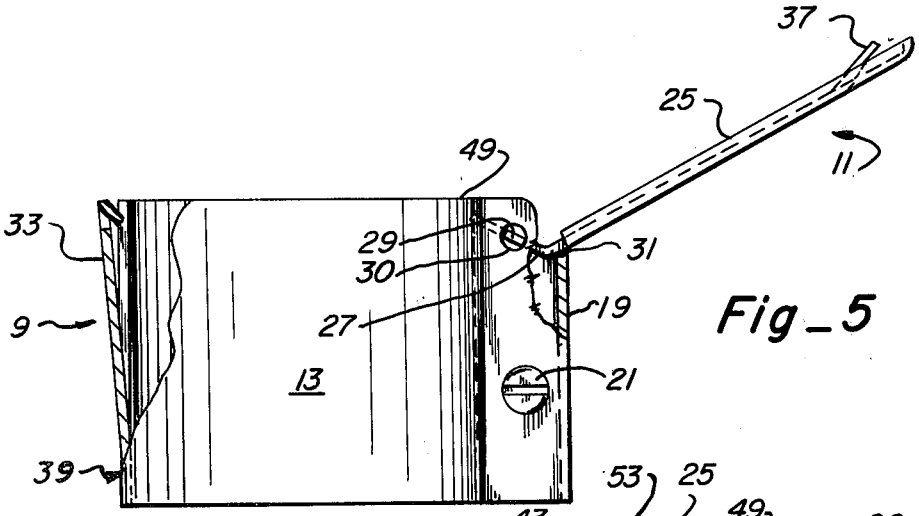
FIG. 5 is a view of the valve cover showing the lid portion in its open position.

The lid portion 11 has a substantially circular, planar first section 25 and a tail section 27 which extends at an angle therefrom. The tail section 27 serves to substantially prevent dirt and other material from entering from above into the C-shaped member 13 between the back portion 15 when the lid portion 11 is in a closed position as best illustrated in FIG. 2. In this manner, dirt and other material are not only kept from entering the member 13 but also from entering the upstanding pipe 3 and falling onto the buried valve 5. The lid portion 11 is mounted to the C-shaped member 13 for pivotal movement about an axis that is substantially perpendicular to the central axis of the member 13. Axially aligned arm members 29 extend outwardly from the tail section 27 of the lid portion 11 and are respectively received in axially aligned holes 30 in each of the first sections 17 of the back portions 15 as illustrated in FIGS. 3 and 5. As the lid portion 11 is moved clockwise in FIG. 5 away from its closed position, it abuts the top edges 31 of the second sections 19 of the back portions 15 to define its open position. The edges 31 are substantially parallel to the pivotal axis of the lid portion 11 and also substantially co-planar therewith.

Figure 6:
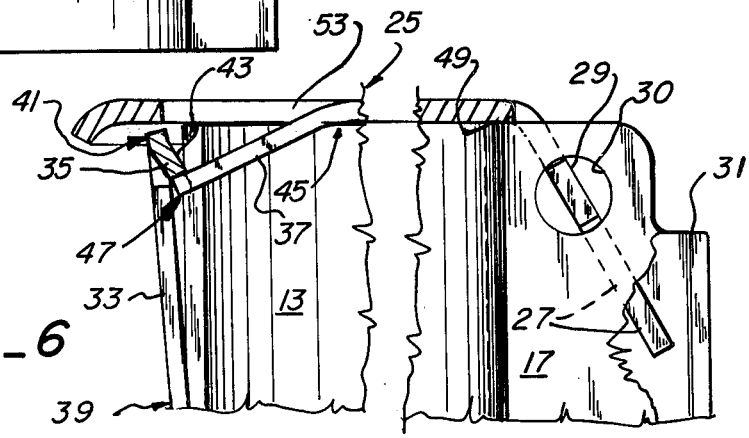
FIG. 6 is a cross-sectional view of the valve cover illustrating the members of the latching arrangement.
Figure 7:
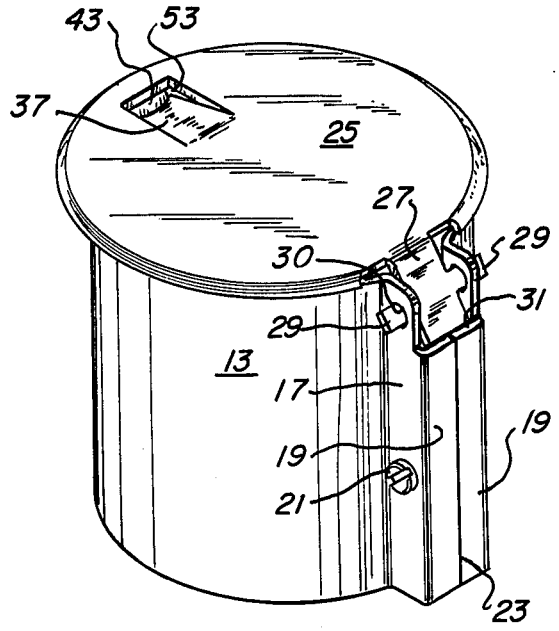
FIG. 7 is a perspective view of the valve cover in its closed position illustrating the opening in the lid portion through which a tool can be inserted to release the latching arrangement.
Figure 8:
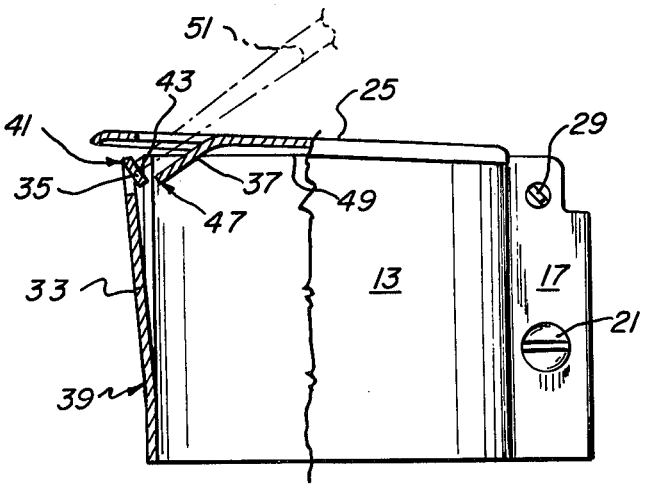
FIG. 8 is a view similar to FIG. 6 further illustrating the manner in which the latching arrangement is released by inserting a tool or other device through the opening in the lid portion to push the resiliently mounted latch member outwardly of the clamping portion. Once released, the biasing force between the lid portion and the clamping portion will cause the lid to pop up.

The latching arrangement for the lid portion 11 is illustrated in FIGS. 6–8 and includes a first member 33 with a detent 35 and a second member 37. Member 33 is resiliently attached at one end 39 to the member 13 and has a free standing end at 41. Detent 35 is positioned near the free end 41 and has a cam surface 43. The second member 37 of the latching arrangement is attached at one end 45 to the section 25 of the lid portion 11 and has a free standing end at 47. As seen in FIG. 7, the second member 37 is cut out from the substantially planar first section 25 of the lid portion 11 and bent downwardly therefrom at an angle. As the lid portion 11 is closed, free end 47 of the second member 37 contacts the cam surface 43 of the detent 35 to move the first member 33 outwardly relative to the C-shaped member 13. Once the free end 47 of the second member 37 moves downwardly beyond the detent 35, the first member 33 resiliently snaps back toward the interior of the C-shaped member 13 with the detent 35 positioned above the second member 37 to hold the lid portion 11 in its closed position.

As illustrated in FIG. 6, the arm members 29 are positioned on the tail section 27 of the lid portion 11 so that they tightly contact the upper portion of the holes 30 as the lid portion 11 is moved toward its closed position. In this manner, the section 25 of the lid portion 11 is biased against the top edges 49 of the member 13 near the back portions 15. With this arrangement, when a finger, screwdriver, or other tool 51 is inserted through the opening 53 in the first section 25 of the lid portion 11 to press the first member 33 of the latching arrangement outwardly of the member 13 to release the free end 47 of the second member 37 from beneath the detent 35, the biasing force of the first section 25 against the top edges 49 of the member 13 causes the lid portion 11 to pop up as illustrated in FIG. 8. The tool 51 can then be removed and the lid portion 11 easily moved to its open position as shown in FIG. 5 to provide access to the interior of the member 13 and the pipe 3.

In addition to the advantages of ease of height adjustability and ease of opening and closing, valve cover 1 of the present invention has the distinct advantages of simplicity of design, low cost of manufacture, and ease of assembly. To assemble the valve cover 1, the back portions 15 of the C-shaped member 13 are spread far enough apart to receive the arm members 29 into the holes 30. Screw member 21 is then tightened to maintain the arm members 20 within the holes 30 and, consequently, to maintain the lid portion 11 pivotably mounted to the clamping portion 9. The valve cover 1 can then be adjusted relative to the pipe 3 and its screw member 23 tightened further so that the C-shaped member 13 frictionally engages the outer surface of the pipe 3. In the preferred operation, edges 23 of the back portions 15 abut each other so that no dirt or other material can pass between them and into the interior of the C-shaped member 13 and pipe 3. However, the valve cover 1 can be used with pipes larger than pipe 3 and the C-shaped member 13 tightened to frictionally engage the outer surface of the larger pipe with the edges 23 spaced from each other. If desired, the outward extent of the arm members 29 from the tail section 27 and the length of the screw member 21 can be increased so that the valve cover 1 of the present invention could be used with pipes of widely varying diameters. The valve cover 1 can be made of a variety of materials including metals and plastics, however, aluminum is preferred because of its relatively low cost and high degree of weatherability. It is also contemplated at this time that the valve cover 1 of the present invention could be placed directly over the valve in certain circumstances rather than being adjustably attached to an upstanding pipe leading to the valve. In this modification, the length of the clamping portion 9 could be extended and the edges 23 welded or otherwise permanently bonded together if desired. It is also contemplated that shims or spacers could be placed next to the inside surface of the C-shaped member 13 to enable it to be secured about smaller diameter pipes.

While several embodiments of the present invention have been described in detail herein, various changes and modifications can be made without departing from the scope of the invention.

I claim:

1. An adjustable valve cover for use with a pipe leading to a valve, said valve cover comprising:

a clamping portion, said clamping portion including a substantially C-shaped member extending along a first axis, said C-shaped member having two back portions extending in a direction substantially parallel to said first axis, said clamping portion further including means for selectively moving said back portions toward each other into an abutting relationship whereby said C-shaped member forms a substantially cylindrical shape with two, open ends spaced from each other along said first axis, a lid portion, said lid portion including a lid member having a first section with an area larger than a first of said two, open ends of said clamping portion, and, means for mounting said lid member to said clamping portion for pivotable movement about a second axis between an open position and a closed position, said second axis being substantially perpendicular to said first axis and said first section of said lid member in said closed position substantially covering said first, open end and preventing access to the interior of said clamping portion through said first, open end whereby said clamping portion can be positioned about and releasably secured to an end portion of said pipe at a desired location by said moving means moving said back portions toward said abutting relationship reducing the area substantially enclosed by said C-shaped member and causing frictional engagement between at least a portion of said C-shaped member and said pipe end portion and said lid member moved between said open and closed positions to alternately provide and prevent access to the interior of said clamping portion and said pipe.

2. An adjustable valve cover for use with a pipe leading to a valve, said valve cover comprising:

a clamping portion, said clamping portion including a substantially C-shaped member extending along a first axis, said C-shaped member having two back portions extending in a direction substantially parallel to said first axis, each of said back portions of said clamping member having a first section extending outwardly of said first axis and the second section attached thereto toward the respective second section of the other back portion, said clamping portion further including means for selectively moving said back portions toward each other into a substantially abutting relationship with said second sections substantially abutting each other and said first sections being spaced from each other whereby said C-shaped member forms a substantially cylindrical shape with two, open ends spaced from each other along said first axis, a lid portion, said lid portion including a lid member having a first section with an area larger than a first of said two, open ends of said clamping portion, and, means for mounting said lid member to said clamping portion for pivotable movement about a second axis between an open position and a closed position, said second axis being substantially perpendicular to said first axis and said first section of said lid member in said closed position substantially covering said first, open end and preventing access to the interior of said clamping portion through said first, open end whereby said clamping portion can be positioned about and releasably secured to an end portion of said pipe at a desired location by said moving means moving said back portions toward said abutting relationship reducing the area substantially enclosed by said C-shaped member and causing frictional engagement between at least a portion of said C-shaped member and said pipe end portion and said lid member moved between said open and closed positions to alternatively provide and prevent access to the interior of said clamping portion and said pipe.

3. The valve cover of claim 2 wherein each of said second sections of said back portions has an edge extending in a direction substantially parallel to said first axis and said moving means moving said back portions toward said relationship with said edges of said second sections substantially abutting each other.

4. The valve cover of claim 2 wherein said first and second sections of each of said back portions meet at a substantially 90 degree angle.

5. The valve cover of claim 4 wherein said lid member further includes a second section attached to said first section and said means for pivotably said lid member to said clamping portion includes two, axially aligned arm members extending outwardly of said second section of said lid member and a pair of axially aligned holes in said first sections of said back portions, each of said arm members being respectively received in one of said holes and extending outwardly of the first section of the respective back portion when said back portions are in said substantially abutting relationship.

6. The valve cover of claim 4 wherein said moving means includes at least one screw member extending between said first sections of said back portions,.

7. The valve cover of claim 2 wherein said back portions have first and second ends spaced from each other in the direction of said first axis when said clamping portion is in said substantially abutting relationship and said valve cover further includes means for substantially preventing access to the space between said first sections at one end of said back portions when said lid member is in said closed position.

8. The valve cover of claim 7 wherein said access preventing means includes a second section of said lid.

9. The valve cover of claim 8 wherein said first and second sections of said lid member are attached to each other at an angle.

10. The valve cover of claim 8 wherein said second section of said lid member has two, axially aligned arm members extending outwardly therefrom and said first sections of said back portions have a pair of axially aligned holes therein, each of said arm members being respectively received in one of said holes and extending outwardly of the first section of the respective back portions when said back portions are in said substantially abutting relationship and said second section of said lid member having at least a portion thereof being received between said first sections of said back portions when said back portions are in said substantially abutting relationship.

11. The valve cover of claim 2 wherein said back portions have first and second ends spaced from each other in the direction of said first axis when said clamping portion is in said substantially abutting relationship and said valve cover further includes means for preventing movement of said lid member about said second axis beyond said open position.

12. The valve cover of claim 11 wherein said second sections of said back portions each have an edge extending in a direction substantially parallel to said second axis, each of said edges being substantially co-planar with said second axis and defining a portion of one end of said back portions, said means for preventing movement of said lid member about said second axis beyond said open position including said edges whereby said lid member abuts against said edges as said lid member is moved about said second axis away from said closed position to define open position.

13. The valve cover of claim 1 further including means for releasably latching said lid member in said closed position and means for biasing said lid member against said latching means in a direction toward said open position whereby said lid member pops away from said closed position when said latching means is released.

14. An adjustable valve cover for use with a pipe leading to a valve, said valve cover comprising:

a clamping portion, said clamping portion including a substantially C-shaped member extending along a first axis, said C-shaped member having two back portions extending in a direction substantially parallel to said first axis, said clamping portion further including means for selectively moving said back portions toward each other into a substantially abutting relationship whereby said C-shaped member forms a substantially cylindrical shape with two, open ends spaced from each other along said first axis, a lid portion, said lid portion including a lid member having a first section with an area larger than a first of said two, open ends of said clamping portion, means for mounting said lid member to said clamping portion for pivotable movement about a second axis between an open position and a closed position, said second axis being substantially perpendicular to said first axis and said first section of said lid member in said closed position substantially covering said first, open end and preventing access to the interior of said clamping portion through said first, open end whereby said clamping portion can be positioned about and releasably secured to an end portion of said pipe at a desired location by said moving means moving said back portions toward said abutting relationship reducing the area substantially enclosed by said C-shaped member and causing frictional engagement between at least a portion of said C-shaped member and said pipe end portion and said lid member moved between said open and closed position to alternately provide and prevent access to the interior of said clamping portion and said pipe, and, means for releasably latching said lid member in said closed position, said latching means including a first member haing first and second ends and means for resiliently attaching said first end to said clamping portion with said second end being free standing, said latching means further including a detent member adjacent said second end of said first member and extending in a direction toward the interior of said clamping portion, said detent member having a cam surface, said latching means further including a second member having first and second ends and means for attaching said first end of said second member to said lid member whereby said second end of said second member contacts said cam surface as said lid member is moved toward said closed position to move said first member outwardly of said clamping portion and said first member resiliently snaps back toward the interior of said clamping portion once said second end of said second member is moved beyond said detent member to define the closed position of said lid member.

15. The valve cover of claim 14 further including means for biasing said lid member against said latching means in a direction towards said open position whereby said lid member pops away from said closed position when said latching means is released.

16. The valve cover of claim 14 wherein said lid member has a first, substantially planar section and said second member of said latching means is a portion cut out of said first section of said lid member and bent at an angle to the plane of said first section, said second member of said latching means and said first section of said lid means defining an opening through said first section providing access to said detent member and said first member of the latching means whereby said latching means can be released by inserting an object through said opening and pushing against said detent member and said first member to move said second, free standing end of said first member of the latching means outwardly of said clamping portion to release said second member of said latching means from contact with said detent member.

17. An adjustable cover for use with a pipe leading to a valve, said valve cover comprising:

a substantially C-shaped clamping member extending along a first axis, said C-shaped clamping member having first and second open ends spaced from each other in the direction of said first axis and two back portions extending substantially between said open ends in a direction substantially parallel to said first axis, each of said back portions of said C-shaped clamping member having a first section extending outwardly of said first axis and a second section attached thereto extending towards the respective second section of the other back portion, means for selectively moving said back portions toward each other to reduce the area substantially enclosed by said C-shaped clamping member whereby said C-shaped clamping member can be selectively, frictionally engaged about an end portion of said pipe at a desired location, said moving means moving said back portions toward each other with said second sections substantially abutting each other and said first sections being spaced from each other, a lid member having a tail section, and, means for mounting said lid member to said C-shaped clamping member for pivotal movement about a second axis between an open position and a closed position, said second axis being substantially perpendicular to said first axis and said lid member in said closed position substantially covering one of said open ends of said C-shaped clamping member and preventing access to the interior of said C-shaped clamping member through said one, open end, said means for pivotally mounting said lis member to said C-shaped clamping member including two, axially aligned arm members extending outwardly of said tail section of said lid member and a pair of axially aligned holes in said first sections of said back portions, each of said arm members being respectively received in one of said holes extending outwardly of the first section of the respective back portions when said second sections of said back portions are in said substantially abutting relationship whereby said C-shaped clamping member can be positioned about and releasably secured to said pipe end portion and said lid member moved between said open and closed positions to alternately provide and prevent access to the interior of said C-shaped clamping member and said pipe.

18. The valve cover of claim 17 wherein said back portions have first and second ends spaced from each other in the direction of said first axis when said second sections of said back portions are in said substantially abutting relationship and said valve cover further includes means for substantially preventing access to the space between said first sections at one end of said back portions when said lid member is in said closed position.

19. The valve cover of claim 18 wherein said access preventing means includes said tail section of said lid member.

20. The valve cover of claim 19 wherein said lid member has a substantially planar first section attached to said tail section at an angle, said first section having an area larger than said one, open end of said clamping member, said first section of said lid member being positioned over said one, open end when said lid member is in said closed position.

21. The valve cover of claim 17 wherein said moving means includes at least one screw member extending between said first sections of said back portions.

22. An adjustable valve cover for use with a pipe leading to a valve, said valve cover comprising:

a substantially C-shaped clamping member extending along a first axis, said C-shaped clamping member having first and second open ends spaced from each other in the direction of said first axis and two back portions extending substantially between said open ends in a direction substantially parallel to said first axis, said back portion having first and second ends spaced from each other in the direction of said first axis and said second sections of said back portions each having an edge extending in a direction substantially parallel to said second axis, each of said edges being substantially co-planar with said second axis and defining a portion of one end of said back portions, means for selectively moving said back portions toward each other to reduce the area substantially enclosed by said C-shaped clamping member whereby said C-shaped clamping member can be selectively, frictionally engaged about an end portion of said pipe at a desired location, a lid member, means for mounting said lid member to said C-shaped clamping member for pivotal movement about a second axis between an open position and a closed position, said second axis being substantially perpendicular to said first axis and said lid member in said closed position substantially covering one of said open ends of said C-shaped clamping member and preventing access to the interior of said C-shaped clamping member through said one, open end whereby said C-shaped clamping member can be positioned about and releasably secured to said pipe end portion and said lid member moved between said open and closed positions to alternately provide and prevent access to the interior of said C-shaped clamping member and said pipe, and, means for preventing movement of said lid member about said second axis beyond said open position, said preventing means including said edges of the second sections of said back portions whereby said lid member abuts against said edges as said lid member is moved about said second axis away from said closed position to define said open position.

23. The valve cover of claim 17 further including means for releasably latching said lid member in said closed position and means for biasing said lid member against said latching means in a direction toward said open position whereby said lid member pops away from said closed position when said latching means is released.

24. An adjustable valve cover for use with a pipe leading to a valve, said valve cover comprising:

a substantially C-shaped clamping member extending along a first axis, said C-shaped clamping member having first and second open ends spaced from each other in the direction of said first axis and two back portions extending substantially between said open ends in a direction substantially parallel to said first axis, means for selectively moving said back portions toward each other to reduce the area substantially enclosed by said C-shaped clamping member whereby said C-shaped clamping member can be selectively, frictionally engaged about an end portion of said pipe at a desired location, a lid member, means for mounting said lid member to said C-shaped clamping member for pivotal movement about a second axis between an open position and a closed position, said second axis being substantially perpendicular to said first axis and said lid member in said closed position substantially covering one of said open ends of said C-shaped clamping member and preventing access to the interior of said C-shaped clamping member through said one, open end whereby said C-shaped clamping member can be positioned about and releasably secured to said pipe end portion and said lid member moved between said open and closed positions to alternately provide and prevent access to the interior of said C-shaped clamping member and said pipe, and, means for releasably latching said lid member in said closed position, said latching means including a first member having first and second ends and means for resiliently attaching said first end to said C-shaped clamping member with said second end being free standing, said latching means further including a detent member adjacent said second end of said first member and extending in a direction toward the interior of said C-shaped clamping member, said detent member having a cam surface, said latching means further including a second member haing first and second ends and means for attaching said first end of said second member to said lid member whereby said second end of said second member contacts said cam surface as said lid member is moved toward said closed position to move said first member outwardly of said C-shaped clamping member and said first member resiliently snaps back toward the interior of said C-shaped clamping member once said second end of said second member is moved beyond said detent member to define the closed position of said lid member.

25. The valve cover of claim 24 further including means for biasing said lid member against said latching means in a direction towards said open position whereby said lid member pops away from said closed position when said latching means is released.

26. The valve cover of claim 24 wherein said lid member has a first, substantially planar section and said second member of said latching means is a portion cut out of said first section of said lid member and bent at an angle to the plane of said first section, said second member of said latching means and said first section of said lid means defining an opening through said first section providing access to said detent member and said first member of the latching means whereby said latching means can be released by inserting an object through said opening and pushing against said detent member and said first member to move said second, free standing end of said first member of the latching means outwardly of said C-shaped clamping member to release said second member of said latching means from contact with said detent member.

27. A valve cover comprising:

a substantially tubular portion having first and second open ends spaced from each other along a first axis, a lid portion, means for mounting said lid portion to said tubular portion for pivotable movement about a second axis between an open and a closed position, said second axis being substantially perpendicular to said first axis and said lid portion in said closed position substantially covering one of said open ends of said tubular portion and preventing access to the interior of said tubular portion through said one, open end, and, means for releasably latching said lid portion in said closed position and means for biasing said lid portion against said latching means in the direction toward said open position whereby said lid portions pops away from said closed position when said latching means is released, said latching means includes a first member having first and second ends and means for resiliently attaching said first end to said tubular portion with said second end being free standing, said latching means further including a detent member adjacent said second end of said first member and extending in a direction toward the interior of said tubular portion, said detent member having a cam surface, said latching means further including a second member having first and second ends and means for attached said first end of said second member to said lid portion whereby said second end of said second member contacts said cam surface as said lid portion is moved toward said closed position to move said first member outwardly of said tubular position and said first member resiliently snaps back toward the interior of said tubular portion once said second end of said second member is moved beyond said detent member to define the closed position of said lid portion.

28. The valve cover of claim 27 wherein said lid portion has a first, substantially planar section and said second member of said latching means is a portion cut out of said first section of said lid portion and bent at an angle to the plane of said first section, said second member of said latching means and said first section of said lid portion defining an opening through said first section providing access to said detent member and said first member of the latching means whereby said latching means can be released by inserting an object through said opening and pushing said detent member and said first member to move said second, free standing end of said first member of the latching means outwardly of said tubular portion to release said second member of said latching means from contact with said detent member.

29. A valve cover comprising:

a substantially tubular portion having first and second open ends spaced from each other along a first axis, a lid portion, means for mounting said lid portion to said tubular portion for pivotable movement about a second axis between an open and a closed position, said second axis being substantially perpendicular to said first axis and said lid portion in said closed position substantially covering one of said open ends of said tubular portion and preventing access to the interior of said tubular portion through said one, open end, and, means for releasably latching said lid portion in said closed position, said latching means includes a first member having first and second ends and means for resiliently attaching said first end to said tubular portion with said second end being free standing, said latching means further including a detent member adjacent said second end of said first member and extending in a direction toward the interior of said tubular portion, said detent member having a cam surface, said latching means further including a second member having first and second ends and means for attaching said first end of said second member to said lid portion whereby said second end of said second member contacts said cam surface as said lid portion is moved toward said closed position to move said first member outwardly of said tubular portion and said first member resiliently snaps back toward the interior of said tubular portion once said second end of said second member is moved beyond said detent member to define the closed position of said lid portion.

30. The valve cover of claim 29 wherein said lid portion has a first, substantially planar section and said second member of said latching means is a portion cut out of said first section of said lid portion and bent at an angle to the plane of said first section, said second member of said latching means and said first section of said lid portion defining an opening through said first section providing access to said detent member and said first member of the latching means whereby said latching means can be released by inserting an object through said opening and pushing said detent member and said first member to move said second, free standing end of said first member of the latching means outwardly of said tubular portion to release said second member of said latching means from contact with said detent member.

31. The valve cover of claim 29 further including means for biasing said lid portion against said latching means in the direction toward said open position whereby said lid portion pops away from said closed position when said latching means is released.

* * * * *